United States Patent [19]

Hemenway, Jr.

[11] Patent Number: 4,955,942

[45] Date of Patent: Sep. 11, 1990

[54] IN-BED TUBE BANK FOR A FLUIDIZED-BED COMBUSTOR

[75] Inventor: Lloyd F. Hemenway, Jr., Morgantown, W. Va.

[73] Assignee: The United States of America as represented by the United States Department of Energy, Washington, D.C.

[21] Appl. No.: 390,849

[22] Filed: Aug. 8, 1989

[51] Int. Cl.[5] ..... F22B 1/00

[52] U.S. Cl. ..... 122/4 D; 122/367.3; 165/104.16

[58] Field of Search ..... 110/245; 122/4 D, 6 A, 122/235 A, 367 C; 165/104.16

[56] References Cited

U.S. PATENT DOCUMENTS 4,492,184 1/1985 Norton et al. ..... 122/4 D
4,704,992 11/1987 Waryasz ..... 122/4 D
4,796,568 1/1989 Pillai ..... 122/4 D
4,848,276 7/1989 Brännström et al. ..... 122/4 D

*Primary Examiner*—Edward G. Favors
*Assistant Examiner*—Denise L. Ferensic
*Attorney, Agent, or Firm*—David E. Breeden; Stephen D. Hamel; William R. Moser

[57] ABSTRACT

An in-bed tube bank (10) for a fluidized bed combustor. The tube bank (10) of the present invention comprises one or more fluid communicating boiler tubes (30) which define a plurality of selectively spaced boiler tube sections (32). The tube sections (32) are substantially parallel to one another and aligned in a common plane. The tube bank (10) further comprises support members (34) for joining adjacent tube sections (32), the support members (34) engaging and extending along a selected length of the tube sections (32) and spanning the preselected space therebetween.

7 Claims, 3 Drawing Sheets

IN-BED TUBE BANK FOR A FLUIDIZED-BED COMBUSTOR

DESCRIPTION

1. Technical Field

This invention relates to in-bed boiler tube banks for fluidized-bed combustors. In this particular invention the tube bank includes one or more fluid communicating boiler tubes defining parallel tube sections joined by support members.

2. Background Art

Fluidized-bed combustors have long been used to facilitate the combustion of low-quality fuels and more recently as a means for the clean burning of coal. In a fluidized-bed combustor fuel is fed into a bed of reactive or inert particulate material while air is injected into the bed and passed up through the bed, causing the bed material to act like a turbulent fluid. Where the combustor is utilized for steam generating one or more boiler tubes are positioned so as to span the bed while submerged in the bed, and as fuel is burned within the bed water is injected into the boiler tubes and heated, thereby generating steam.

In some applications a plurality of single boiler tubes are utilized each having a linear tube section which substantially spans the bed, with boiler tubes being disposed such that the linear tube sections run horizontally and parallel to one another, and with the sections being vertically in line. In this design the boiler tubes are generally supported at either end of the bed. Also, serpentine boiler tubes have been used, each such tube comprising a single run of tube configured so as to define a plurality of linear tube sections which are parallel to one another and in vertical alignment when the tube is mounted in the bed. In this design the practical effect of the serpentine configuration is the supporting of the linear tube sections at opposite ends of the bed. However, in conventional combustors utilizing such tube configuration the boiler tubes have experienced metal wastage during operation of the combustor. Such wastage is due in large part to stresses on the tubes due to vertical loads from dynamic in-bed forces, and to vibration due to resonance.

In this regard, in commercial combustors the boiler tubes, or the linear sections thereof which span the bed, act as single units and therefore have very low natural frequencies of vibration making them highly susceptible to induced vibration. The moment of inertia is also quite small which results in relatively high stresses. The high stresses and/or vibration at high temperatures along with the possibility of corrosive agents within the bed can cause metal wastage due to the phenomena of creep, inelastic strain, oxide exfoliation due to tensile stresses, fatigue corrosion, and stress corrosion, and cyclic fatigue. Creep can also shorten the fatigue life of the tubes. All of these phenomena can contribute to tube metal wastage and greatly shorten the life of in-bed tubes.

Therefore, it is an object of the present invention to provide an in-bed tube bank for a fluidized-bed combustor which is less susceptible to tube metal wastage.

Another object of the present invention is to provide an in-bed tube bank for a fluidized-bed combustor which is better able to withstand stresses on the boiler tubes due to vertical loads from dynamic in-bed forces.

A further object of the present invention is to provide an in-bed tube bank for a fluidized-bed combustor having an increased natural frequency of vibration so as to be less susceptible to induced vibration.

Yet another object of the present invention is to provide an in-bed tube bank for a fluidized-bed combustor which is inexpensive to manufacture and maintain.

DISCLOSURE OF THE INVENTION

Other objects and advantages will be accomplished by the present invention which provides an in-bed tube bank for a fluidized-bed combustor. The tube bank comprises a plurality of fluid communicating boiler tubes each defining a boiler tube section for substantially spanning the fluidized-bed. The boiler tubes are disposed within the bed such that the boiler tube sections of the various tubes are selectively spaced in substantially parallel alignment. The tube bank further comprises support members for joining adjacent tube sections, the support members extending a selected length along the tube sections and spanning the preselected space therebetween. As the result of the joining of the tube sections along a substantial portion of their lengths the boiler tubes act as a single unit and the tube sections are better able to withstand stress due to in-bed forces. Further, the natural frequency of the tube bank is increased so as to reduce the possibility of resonance. In an alternate embodiment of the tube bank of the present invention the tube bank comprises a single serpentine configured boiler tube which defines a plurality of substantially parallel tube sections joined by the support members of the present invention.

BRIEF DESCRIPTION OF THE DRAWINGS

The above-mentioned features of the present invention will become more clearly understood from the following detailed description of the invention read together with the drawing in which.

BEST MODE FOR CARRYING OUT THE INVENTION

Figure 1:
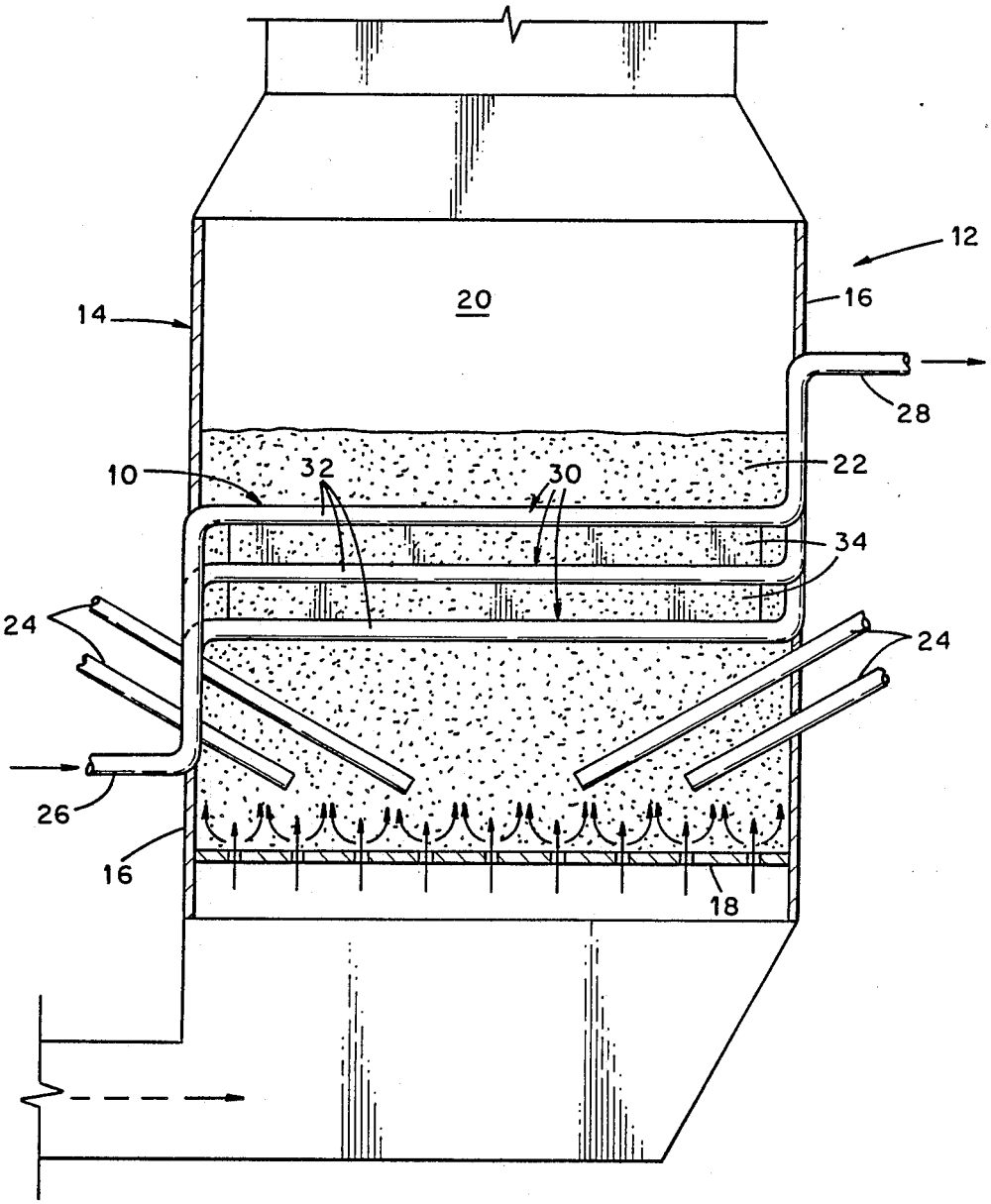
FIG. 1 illustrates a diagrammatic side elevation view of an in-bed tube bank of the present invention positioned in a fluidized-bed combustor.

An in-bed tube bank for a fluidized-bed combustor incorporating various features of the present invention is illustrated at 10 in the Figures. It will be recognized by those skilled in the art that the tube bank 10 can be used in various applications where in-bed tube banks are required in a fluidized-bed environment. However, for purposes of illustration, a fluidized-bed steam generator incorporating a tube-bank 10 is diagrammatically illustrated at 12 in FIG. 1.

As illustrated, the steam generator 12 comprises a furnace housing 14 having water walls 16 and a preformated floor 18 or a floor provided with air injection nozzles (not shown). The housing 14 defines a furnace chamber 20 therein which is partially filled with a bed material 22, the bed material 22 being either a reactive or inert particulate. In this regard, where the fuel utilized by the generator 12 is coal the bed material is typically limestone which reduces sulfur dioxide emissions by reacting with and absorbing the sulfur in the coal. The tube bank 10 is positioned within the chamber 20 so as to be covered, and surrounded by, the bed material 22. The bed material 22 is fluidized by injecting air through the floor 18 of the housing 14 at a preselected velocity. A suitable fuel is then introduced to the fluidized bed, as for example via the fuel supply tubes 24, and the fuel is ignited, thereby heating the tube bank 10. As a result water input into the tube bank 10 on the input side 26 of the bank 10 is heated, and exits the bank 10 on the output side 28 as steam.

Figure 2:
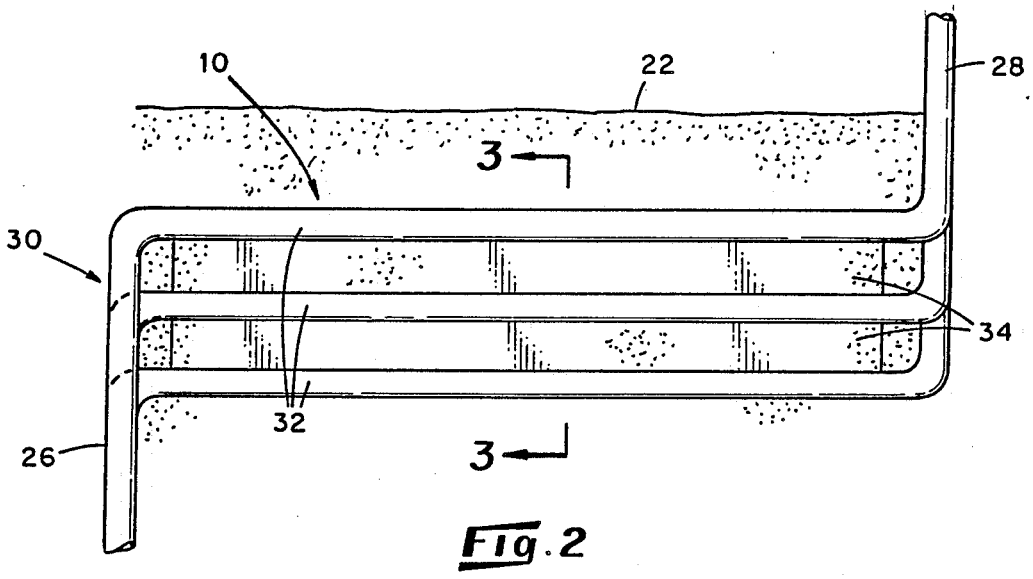
FIG. 2 illustrates a side elevation view of an in-bed tube bank of the present invention.
Figure 3:
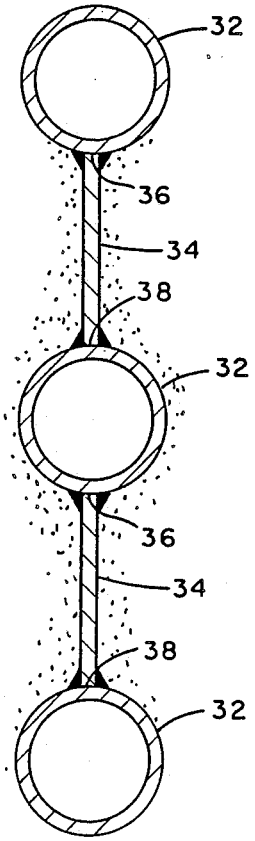
FIG. 3 illustrates an end view, in section, of an in-bed tube bank of the present invention.

Referring now to FIGS. 2 and 3, in the preferred embodiment the tube bank 10 comprises a plurality of boiler tubes 30 each of which defines a substantially horizontally disposed tube section 32. Preferrably the tubes 30 are fabricated of a strong, durable metal. The boiler tubes 30 are positioned with respect to one another such that the tube sections 32 are selectively spaced with the axes of the tube sections 32 being substantially aligned in a common, preferably vertical, plane, and such that the tube sections 32 are substantially parallel to one another. In order to reduce stress levels on the tubes 30 and increase the natural frequency of vibration so that tube wastage in mitigated, support members 34 are used to connect the adjacent boiler tube sections 32. In the preferred embodiment the support members 34 are fabricated from a strong, durable metal and each comprises an elongated plate defining a first edge portion 36 secured (as by welding) to one tube section 32 and a further edge portion 38 secured (as by welding) to the adjacent tube section 32. Further, in the preferred embodiment the support members 34 extend substantially the length of the adjacent tube sections 32. As a result of the joining of the tube sections 32 the tubes 30 act as a single unit rather than independent tubes, thereby minimizing stresses on the tubes 30 due to vertical loads from dynamic in-bed forces. Moreover, the natural frequency of vibration is substantially increased utilizing this construction which minimizes the possibility of resonance and damage to the tubes 30 due to vibration.

Figure 4:
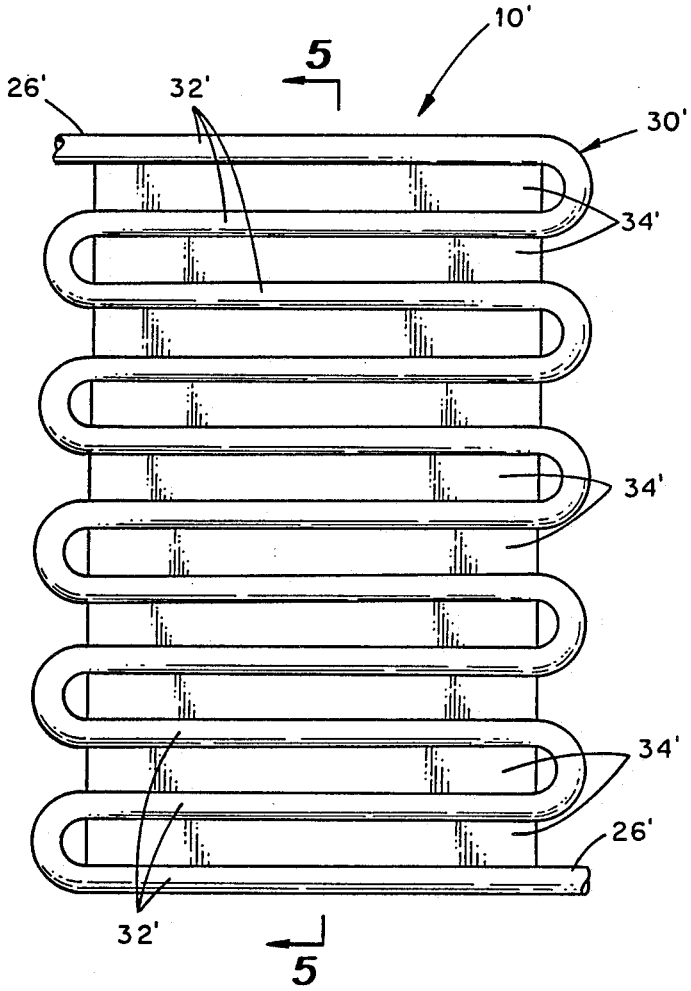
FIG. 4 illustrates a side elevation view of an alternate embodiment of an in-bed tube bank of the present invention.
Figure 5:
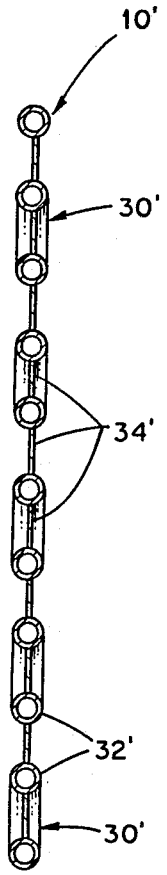
FIG. 5 illustrates an end view, in section, of an alternate embodiment of an in-bed tube bank of the present invention.

In FIGS. 4 and 5 an alternate embodiment of the in-bed tube bank of the present invention is illustrated at 10'. It will be noted that the tube bank 10' comprises a single boiler tube 30, defining a serpentine configuration having a pluraltiy of selectively spaced, substantially parallel tube sections 32'. Further the tube sections 32' are joined with support members 34' as described above with respect to the tube bank 10, thereby causing the bank 10' to act more like a single unit rather than independent boiler tubes supported at their opposite ends as is the case with conventional serpentine boiler tube banks.

In light of the above it will be recognized that the in-bed tube bank of the present invention has great advantages over the prior art. In this regard, wastage of boiler tubes due to tensile stresses is greatly minimized resulting in extended tube life. Resultantly, the associated fluidized-bed combustor can remain in operation for longer periods of time, with a significant reduction in maintenance costs.

While a preferred embodiment has been shown and described, it will be understood that there is no intent to limit the invention to such disclosure, but rather it is intended to cover all modifications and alternate constructions falling within the spirit and scope of the invention as defined in the appended claims.

What is claimed is:

1. An in-bed tube bank for a fluidized-bed combustor, said tube bank comprising at least one boiler tube and a plurality of selectively spaced boiler tube sections for being immersed in the fluidized-bed of said combustor, and further comprising at least one support member for joining said tube sections, said support member engaging and extending substantially the length of said tube sections, and spanning said preselected space therebetween, whereby boiler tube wastage due to stress on said tubes from in-bed forces and due to vibration is mitigated.

2. The tube bank of claim 1 wherein said tube bank comprises a plurality of boiler tubes, each said boiler tube defining one said tube section.

3. The tube bank of claim 1 wherein said tube bank comprises a single boiler tube defining a serpentine configuration and a plurality of said boiler tube sections, whereby said tube sections define serially connected fluid communication tube paths.

4. The tube bank of claim 1 wherein said support member comprises an elongated plate defining opposite edge portions for engaging said boiler tube sections.

5. The tube bank of claim 1 wherein each said tube section defines first and second end portions and wherein said support member extends from a point proximate said first end portions of said tube sections to a point proximate said second end portions of said tube sections.

6. An in-bed tube bank for a fluidized-bed combustor having a fluidized-bed, said tube bank comprising:

a plurality of fluid communicating boiler tubes, each said boiler tube defining a boiler tube section for being immersed in said fluidized-bed, each of said tube section having first and second end portions, said boiler tubes being disposed such that said boiler tube sections are selectively spaced and extend substantially parallel to one another and define axes disposed substantially in a preselected, common plane; and at least one support member for joining adjacent tube sections, said support member defining an elongated plate extending from a point proximate said first end portions of said adjacent tube sections to a point proximate said second end portion of said adjacent tube sections and spanning said preselected space therebetween, whereby boiler tube wastage due to stress on said tubes from in-bed forces, and due to vibration, is mitigated.

7. An in-bed tube bank for a fluidized-bed combustor having a fluidized-bed, said tube bank comprising:

a fluid communicating boiler tube, said boiler tube defining a serpentine configuration and a plurality of selectively spaced boiler tube sections for being immersed in said fluidized-bed, each said tube section defining first and second end portions, said boiler tube sections extending substantially parallel to one another and being substantially aligned in a common plane; and a plurality of support members for joining adjacent boiler tube sections, each said support member defining an elongated plate extending from a point proximate said first end portions of said adjacent tube sections to a point proximate said second end portions of said adjacent tube sections and spanning said preselected space therebetween, whereby boiler tube wastage due to stress on said boiler tubes from in-bed forces, and due to vibration is mitigated.

* * * * *